United States Patent [19]

Petrini

[11] 3,940,808

[45] Mar. 2, 1976

[54] PATIENT TRANSFER APPARATUS

[76] Inventor: Bartholomew Petrini, 7517 North Ridge Drive, Omaha, Nebr. 68112

[22] Filed: Oct. 21, 1974

[21] Appl. No.: 516,282

[52] U.S. Cl. ..... 5/86; 5/81 R; 5/89

[51] Int. Cl.[2] ..... A61G 1/02

[58] Field of Search ..... 5/81, 86, 88, 89, 90, 91, 5/92

[56] References Cited

UNITED STATES PATENTS

| | | | |
|---|---|---|---|
| 2,757,388 | 8/1956 | Chisholm | 5/92 |
| 2,902,701 | 9/1959 | Driskill | 5/90 |
| 3,189,345 | 6/1965 | Simpson | 5/81 R |
| 3,234,568 | 2/1966 | Fischer | 5/89 |
| 3,394,933 | 7/1968 | Benoit | 5/81 R |
| 3,469,269 | 9/1969 | Brown | 5/86 |

*Primary Examiner*—Casmir A. Nunberg
*Attorney, Agent, or Firm*—Zarley, McKee, Thomte & Voorhees

[57] ABSTRACT

A patient transfer apparatus comprising a wheeled base having a vertically disposed post extending upwardly therefrom. A tubular support is vertically slidably movable on the post and has a pair of pivotal arms extending therefrom in a spaced apart relationship. A third arm is secured to the tube and extends upwardly and outwardly therefrom between the pair of arms. Power means is provided for raising and lowering the tube relative to the post. The post is selectively rotatably mounted on the base to permit the precise positioning of the arms. The arms are adapted to support the chair means for transferring the patient.

8 Claims, 15 Drawing Figures

PATIENT TRANSFER APPARATUS

BACKGROUND OF THE INVENTION

This invention relates to a patient transfer apparatus and more particularly to an apparatus which may be used for transferring a patient from a bed to a chair and vice versa. More particularly, the invention pertains to an apparatus which is convenient to use and which permits an individual to transfer a patient in a convenient and safe manner.

Therefore, it is a principal object of the invention to provide an improved patient transfer apparatus.

A still further object of the invention is to provide a patient transfer apparatus which is safe and convenient to use.

A further object of the invention is to provide a patient transfer apparatus for moving a patient from a bed to a chair and vice-versa.

A still further object of the invention is to provide a chair for use with a patient transfer apparatus.

A still further object of the invention is to provide a patient transfer apparatus having adjustment means thereon enabling the apparatus to be used in various environments.

A further object of the invention is to provide a patient transfer apparatus including a vertically adjustable support post which is selectively rotatably mounted about its longitudinal axis.

A further object of the invention is to provide a patient transfer apparatus which is economical of manufacture and durable in use.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 11:
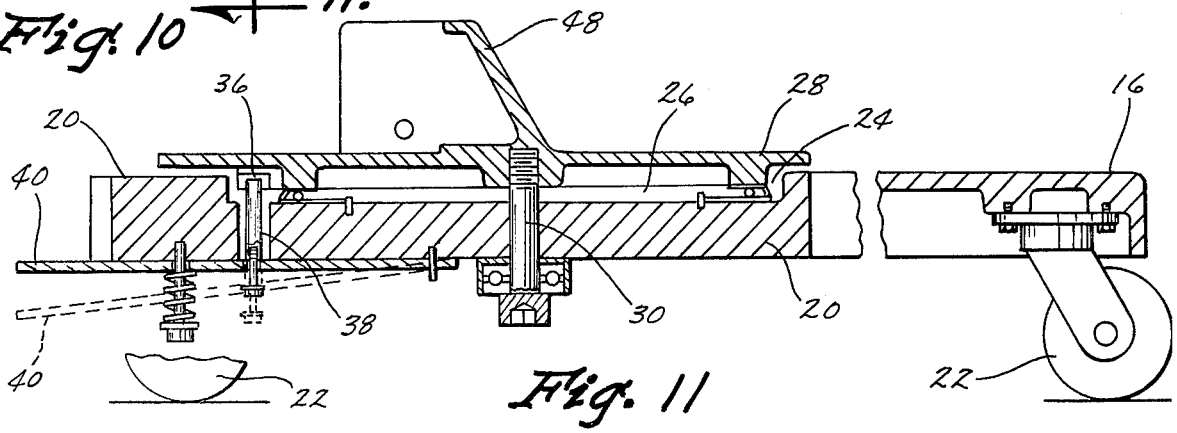
FIG. 11 is an enlarged sectional view seen on lines 11 — 11 of FIG. 10.
Figure 13:
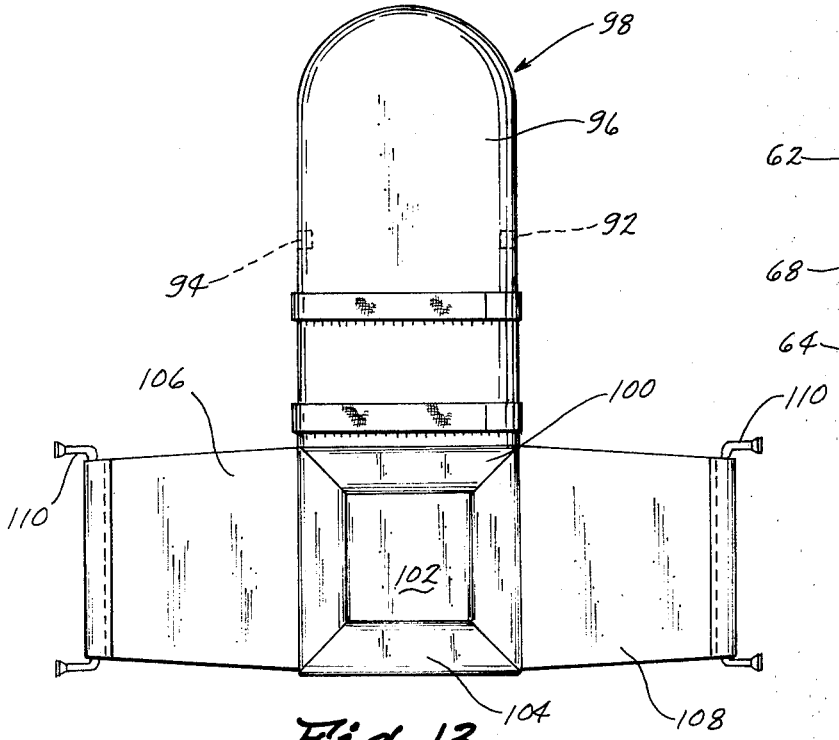
FIG. 13 is a plan view of the patient seat of FIG. 1 in a flat position.
Figure 14:
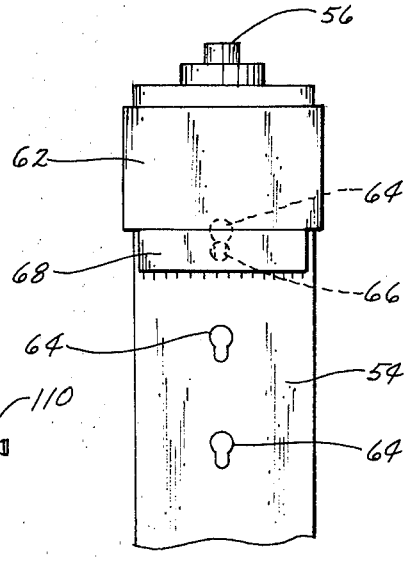
FIG. 14 is a rear view of the upper portion of the support tube.
Figure 15:
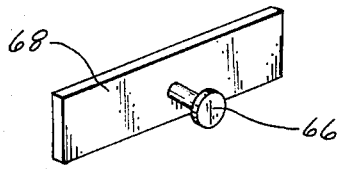
FIG. 15 is a view of the bracket retainer pin.

The numeral 10 refers generally to the apparatus of this invention generally comprising a caster wheel supported base 12 and a support means 14. Base 12 comprises a pair of legs 16 and 18 extending forwardly from base area 20. Caster wheels 22 are provided on the base area 12 and the legs 16 and 18 to permit the apparatus to be easily maneuvered. Base area 20 includes a recessed area 24 formed in its upper surface which receives a bearing assembly 26. Plate 28 is selectively rotatably mounted on bearing assembly 26 and area 20 by bolt 30 extending therethrough. The underside or bottom surface 32 of plate 28 is provided with a downwardly extending support ring 34 which engages the upper surface of bearing assembly 26. Ring 34 is provided with a plurality of spaced apart grooves 36 which are adapted to receive a spring loaded plunger 38 extending upwardly through base area 20 as seen in FIG. 11. Plunger 38 is controlled by foot pedal 40 to permit plate 28 to be locked in various of its positions of rotation relative to base area 20. The numeral 42 refers to a stop or brake element which extends downwardly from base area 20 to lock the apparatus in position or to prevent the apparatus from inadvertently rolling.

Hollow post 46 is secured at its lower end to the upwardly extending channel-like support 48 by bolts or the like. A conventional screw motor assembly 50 is positioned within post 46 and its operated by the conventional battery pack 49 to cause rotation of the screw 52. A tube 54 slidably embraces post 46 and is secured to the screw 52 in conventional fashion so that the rotation of screw 52 by the battery pack, including an electric motor, causes tube 54 to vertically move relative to post 46. A manual crank apparatus 56 is positioned on the upper end of tube 54 and is operatively connected to screw 52 to permit the selective rotation thereof should a power failure occur. The screw motor assembly 50 is controlled by a control box 58 magnetically affixed to shelf 60 on tube 54. If desired, the screw motor assembly 50 may be operated by conventional 110 - 115 volt A.C. current.

Bracket 62 is selectively vertically mounted on tube 54. Tube 54 is provided with a plurality of spaced apart openings 64 formed in its rearward side which are adapted to receive the pin 66 of stop element 68. The lower rearward portion of bracket 62 engages the stop element 68 to limit the downward movement of bracket 62 relative to tube 54 so that the bracket 62 may be selectively vertically positioned on the tube 54.

Bracket 62 is provided with a vertically disposed opening 70 extending downwardly thereinto which is adapted to receive the lower end of arm 72. As seen in the drawings, arm 72 genrally comprises a vertically disposed portion 74 and a horizontal portion 76. A hook means 78 is provided on the outer end of the arm 72 for receiving the hinged yoke 80. Yoke 80 includes a crossbar 82 and downwardly extending arms 84 and 86 hingedly secured thereto. The lower ends of the arms 84 and 86 are provided with inwardly extending portions 88 and 90 which are adapted to be received by tubes 92 and 94 mounted on the underside or back side of back portion 96 of patient support 98.

Patient support 98 also comprises a seat portion 100 which is foldably connected to the lower end of back portion 96 and which has a removable portion 102 selectively closing an opening 104. With the removable portion 102 removed, the patient support may be employed to position the patient on a toilet or the like. Patient support 98 also includes a pair of side flaps 106 and 108 extending laterally from seat portion 100 and which have hooks 110 provided on the outer ends thereof.

Figure 1:
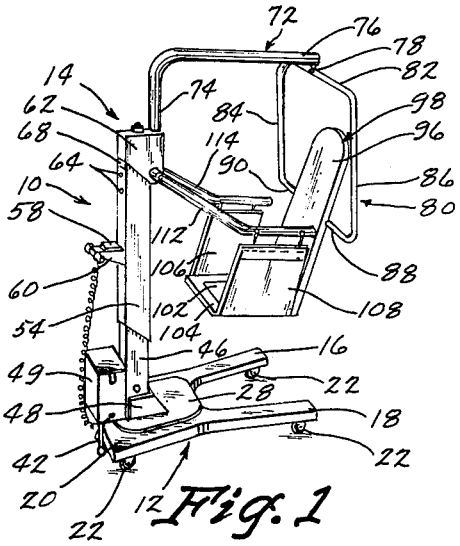
FIG. 1 is a perspective view of the apparatus having the patient chair attached thereto.
Figure 3:
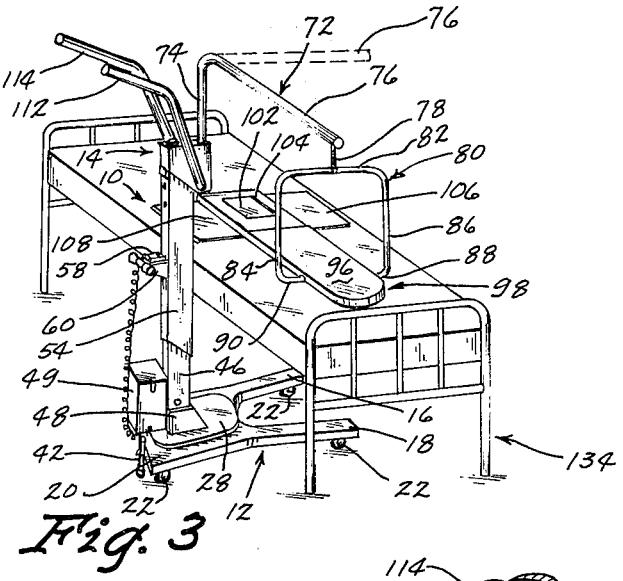
FIG. 3 is a perspective view illustrating the apparatus in one of its positions.
Figure 6:
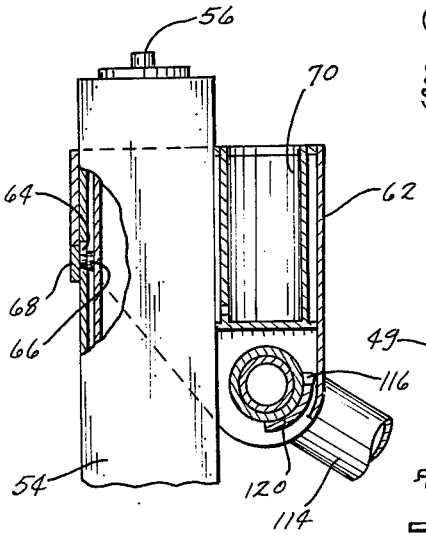
FIG. 6 is a sectional view seen on lines 6 — 6 of FIG. 5.
Figure 4:
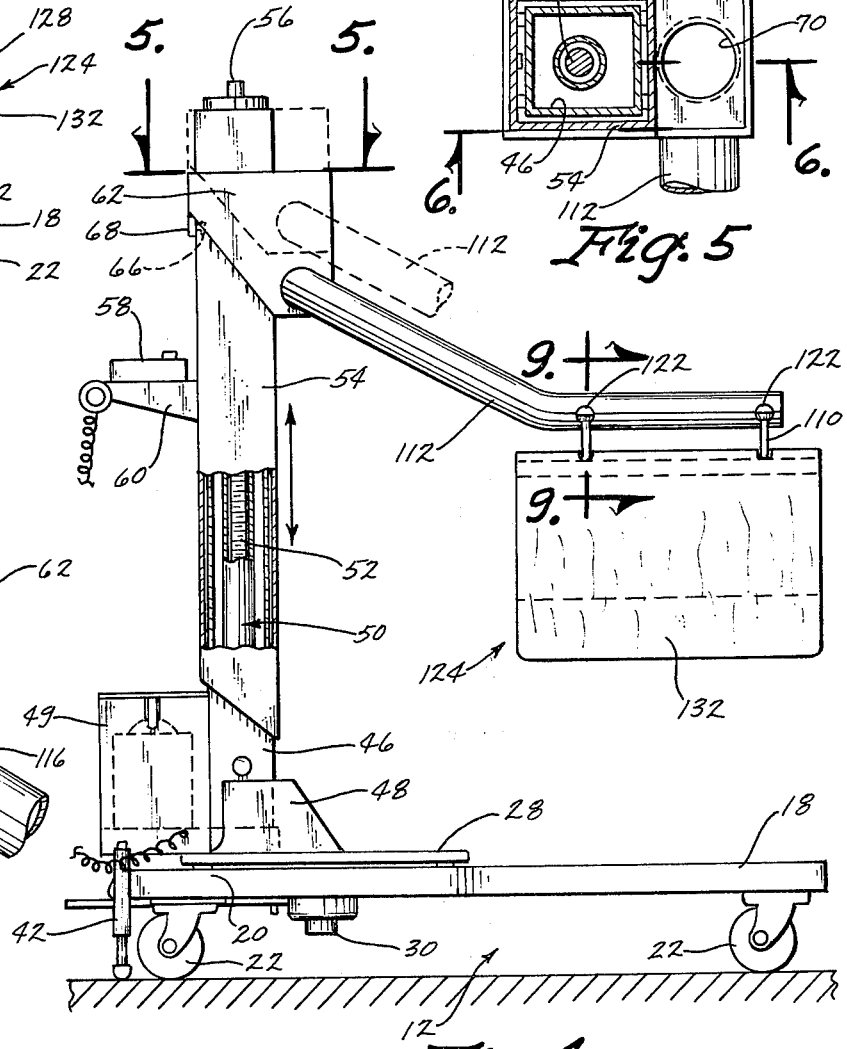
FIG. 4 is a side view of the apparatus of FIG. 2 with portions thereof cut-away to more fully illustrate the invention.
Figure 7:
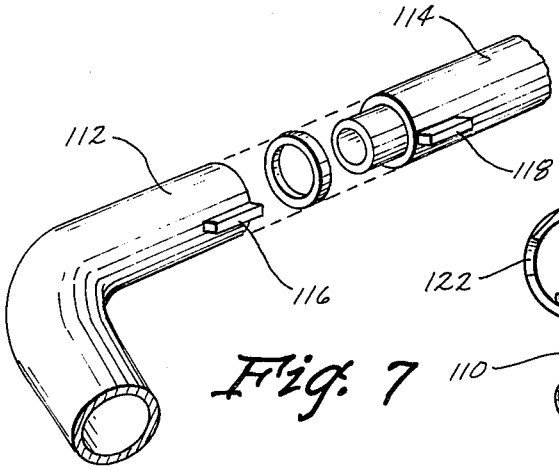
FIG. 7 is an exploded perspective view of one of the support arms.
Figure 9:
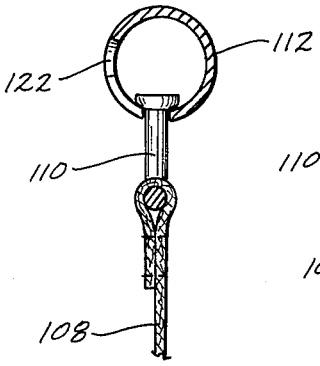
FIG. 9 is a sectional view seen on lines 9 — 9 of FIG. 4.
Figure 8:
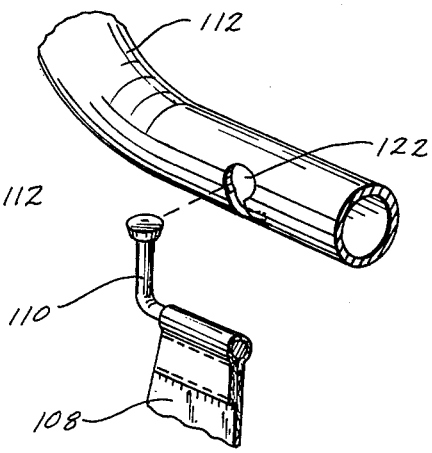
FIG. 8 is a perspective view illustrating the means of attaching the seat to the support arm.
Figure 10:
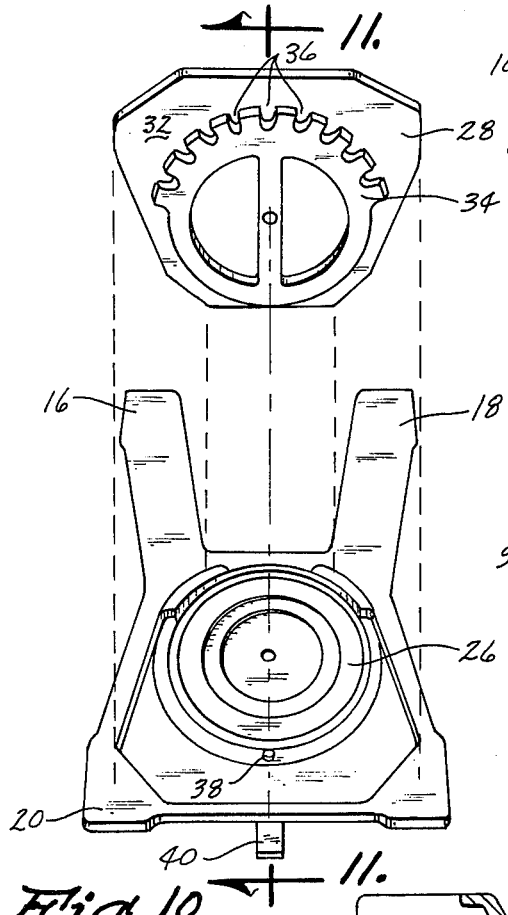
FIG. 10 is an exploded view of the support base.
Figure 12:
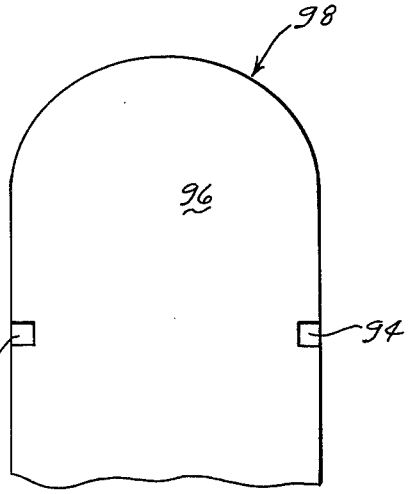
FIG. 12 is a partial back view of the patient seat of FIG. 1.

Support arms 112 and 114 are pivotally mounted on the bracket 62 about a horizontal axis and may be moved from the position of FIG. 1 to the position of FIG. 3 as desired. The inner ends of support arms 112 and 114 are rotatably connected as illustrated in FIG. 7 and are provided with stop elements 116 and 118 welded thereto. The stops 116 and 118 are adapted to engage a limiting element 120 provided within bracket 62 to limit the downward pivotal movement of the arms as illustrated in FIG. 6. The arms 112 and 114 may be individual selectively pivotally moved or may be made integrally so that both of the arms are pivoted simultaneously. However, the preferred embodiment is to permit the arms to be individually pivotally moved as required.

Support arms 112 and 114 are provided with openings 122 adapted to receive the elements 110 extending from flaps 106 and 108 as illustrated in the drawings.

Figure 2:
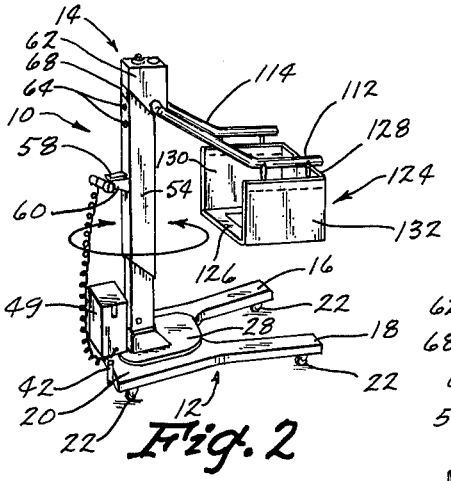
FIG. 2 is a perspective view of the apparatus illustrating a modified form of the patient chair being mounted thereon.
Figure 5:
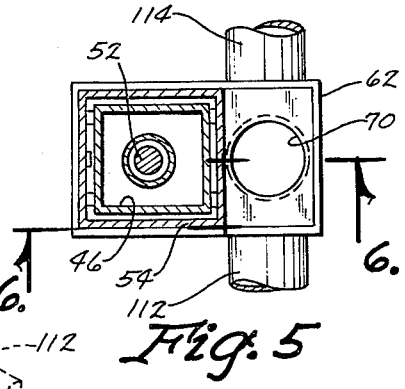
FIG. 5 is an enlarged sectional view seen on lines 5 — 5 of FIG. 4.

FIG. 2 illustrates a modified form of the patient support which is designed to be used from transferring the patient from chair to chair as opposed to bed to chair situation. In FIG. 2, it can be seen that the patient support 124 includes a seat portion 126, back portion 128 and flaps 130 and 132. The patient support 124 is connected to the arms 112 and 114 as previously described and it can be seen that the patient support 124 does not require the use of the support arm 72.

The method of using the apparatus of FIGS. 1 and 2 is as follows. Assuming that the patient is positioned on the bed 134 in a horizontal position, the patient support 98 is slipped beneath the patient in a flat condition so that the patient's buttocks will be positioned over the seat portion 100. The flaps 106 and 108 are folded outwardly so as to extend outwardly from opposite sides of the patient. The apparatus 10 is then wheeled to a position adjacent the bed such as FIG. 3 after the arms 112 and 114 have been pivotally moved upwardly to the position illustrated in FIG. 3. The apparatus is maneuvered so that the yoke 80 may be secured to the tubes 92 and 94 on the underside of back portion 96. The screw motor assembly 50 is then actuated to cause the tube 54 to be vertically moved upwardly relative to the post 46. Upward movement of the tube 54 causes the portions 88 and 90 to be urged inwardly in the tubes 92 and 94 due to the hinge construction of the yoke. Continued upward movement of the tube 54 causes the patient to be gradually moved upwardly to a sitting position. When the patient is in the sitting position, the patient is turned so that his legs extend toward the apparatus. The arms 112 and 114 are then pivotally moved downwardly to the position of FIG. 1 so that the arms are positioned on either side of the patient. The hooks 110 on the flaps 106 and 108 are then positioned in the openings 122 in the arms 112 and 114. Screw motor assembly 50 is then again energized to raise the tube 54 and the arms 72, 112 and 114 so that the patient is lifted from the bed. With the patient lifted from the bed, the apparatus 10 is then wheeled away therefrom. The apparatus may be wheeled to the desired position and the tube 54 lowered through the screw motor assembly 50 so that the patient may be lowered into a wheel chair, chair or onto a toilet as previously described.

After the patient has been lowered to the desired position, the yoke 80 and the arms 112 and 114 may be disconnected from the support so that the apparatus may be moved to a convenient location. When it is desired to transfer the patient to a new position, it is simply necessary to again connect the flaps 106 and 108 to the arms 112 and 114 and to connect the yoke 80 to the tube 92 and 94. The patient may then be moved to the desired location.

As previously described, the patient support 124 described in FIG. 2 is provided to transfer the patient from one sitting position to another sitting position. The support 124 does not require the use of the arm 72 since the arm 72 is designed primarily to raise the patient to a sitting position when the patient is lying on a bed. The operation of the apparatus when using the support 124 is identical to that just described.

The fact that the post 46 is selectively pivotally mounted on the base permits the support arms to be precisely maneuvered as desired. The locking feature of the post relative to the base is important in that the post 46 will not inadvertently pivot relative to the base until the desired time. The brake element 42 positively engages the floor or supporting surface to prevent inadvertent movement of the apparatus thereby providing an additional safety feature.

Thus it can be seen that a novel patient transfer apparatus has been provided which permits the patient to be transferred from a bed to a chair and vice-versa without the necessity of manually lifting the patient. The fact that the patient does not have to be manually lifted permits an individual to easily move the patient from one location to another location. The fact that the tube 54 is vertically mounted on the post 46 provides a great amount of versatility to the device. Additional versatility is provided due to the fact that the bracket 62 is also selectively vertically positioned relative to the tube 54 to permit the apparatus to accommodate beds and chairs of extreme vertical variances. Thus it can be seen that a novel patient transfer apparatus has been provided which accomplishes at least all of its stated objectives.

I claim:

1. A patient transfer apparatus, comprising, a wheeled base, an upstanding post means secured at its lower end to said base and extending upwardly therefrom, said post means being length extendible, power means for extending said post means, a patient support means secured to said post means and extending therefrom, said patient support means comprising a bracket means which embraces said post means and which is selectively, vertically, adjustably mounted on said post means, first and second spaced apart support arms extending laterally therefrom, said support arms being individually, pivotally mounted on said bracket means to permit said arms to be moved between a lower patient support position and an upper inoperative position, and a third support arm secured to said bracket means and extending upwardly and outwardly therefrom, said third support arm comprising a substantially vertically disposed portion positioned intermediate of said first and second support arms, said vertically disposed portion being rotatably mounted on said bracket means about a vertical axis, said third support arm also comprising a substantially horizontally extending portion extending from the upper end of said vertically disposed portion.

2. The apparatus of claim 1 wherein said patient support means also comprises a foldable chair means comprising a rigid seat portion, a rigid back portion foldably secured to said seat portion, a pair of laterally extending flap members foldably secured to seat portion at opposite sides thereof, means for detachably connecting said back portion to said third support arm, and means for detachably connecting said flap members to said first and second support arms respectively.

3. The apparatus of claim 2 wherein said means for detachably connecting said back portion to said third support arm comprises a pivotal yoke means secured to said third support arm, said yoke means comprising upper yoke members pivotally secured together about a horizontal axis and extending outwardly therefrom and a pair of leg portions extending downwardly from the outer ends of said yoke members, said upper yoke members being secured to said third support arm at their said horizontal pivotal connection whereby said leg portions tend to move towards one another when weight is imposed on said chair means.

4. The apparatus of claim 2 wherein said seat portion has an opening formed therein, and a cover element removably closing said opening.

5. A patient transfer apparatus, comprising, a wheeled base, an upstanding post means secured at its lower end to said base and extending upwardly therefrom, said post means being length extendible, power means for extending said post means, a patient support means secured to said post means and extending therefrom, said patient support means comprising a bracket means which embraces said post means and which is selectively, vertically, adjustably mounted on said post means, and first and second spaced apart support arms extending laterally therefrom.

6. The apparatus of claim 5 wherein said support arms are individually, pivotally mounted on said bracket means to permit said arms to be moved between a lower patient support position and an upper inoperative position.

7. The apparatus of claim 5 wherein said patient support means also comprises a chair means comprising a rigid seat portion, a rigid back portion extending upwardly from said seat portion, a pair of upwardly extending side members secured to said seat portion at opposite sides thereof, and means for detachably connecting said side members to said first and second support arms.

8. The apparatus of claim 5 wherein said patient support means also comprises a third support arm extending upwardly and outwardly from said post means between said first and second support arms.

* * * * *